United States Patent [19]

Merrick

[11] Patent Number: 4,981,195

[45] Date of Patent: Jan. 1, 1991

[54] ALTERNATING TREAD LADDER APPARATUS

[76] Inventor: Harry G. Merrick, N. 31910 Pend O'Reille Rd., Chattaroy, Wash. 99003

[21] Appl. No.: 415,035

[22] Filed: Sep. 29, 1989

[51] Int. Cl.[5] ..... E06C 9/02

[52] U.S. Cl. ..... 182/100; 182/189; 182/228

[58] Field of Search ..... 182/100, 189, 228, 92, 182/220, 194

[56] References Cited

U.S. PATENT DOCUMENTS

| | | | |
|---|---|---|---|
| 591,418 | 10/1897 | Noyes | 182/189 |
| 799,360 | 9/1905 | Smith | 182/189 |
| 821,498 | 5/1906 | Jackson | 182/220 |
| 950,182 | 2/1910 | Mercer | 182/189 |
| 2,246,457 | 6/1941 | Schultz | D25/68 |
| 2,744,674 | 5/1956 | Smith | 182/189 |
| 3,017,155 | 1/1962 | Scarpetti | D25/68 |
| 3,259,209 | 7/1966 | Brown | 182/189 |
| 3,310,132 | 3/1967 | Rolland | 182/189 |
| 3,360,075 | 12/1967 | Gutner | 182/106 |
| 3,930,562 | 1/1976 | Zorn | 182/100 |
| 4,199,040 | 4/1980 | Lapeyre | 182/93 |
| 4,328,880 | 5/1982 | Lapeyre | 182/93 |
| 4,592,446 | 6/1986 | White | 182/189 |

OTHER PUBLICATIONS

"The Lapeyre Stair" Brochure.

"Lapeyre Stair" Brochure, 1988.

*Popular Science* "What's New—Home Improvement", Sep. 1988, vol. 233, No. 3, p. 98.

*Primary Examiner*—Reinaldo P. Machado

[57] ABSTRACT

An alternating tread ladder apparatus and an associated tread step bracket are disclosed. The apparatus comprises an elongated central tread support for mounting between a upper level and a lower level at some predetermined forward angle of inclination. The tread support is provided with a plurality of generally laterally oriented tread support apertures positioned therealong and extending therethrough. The preferred embodiment tread step brackets are comprised of angled Z-shape. The upper arm of the Z is longer than the lower arm, and entends through one of the apertures in the central tread support.

23 Claims, 4 Drawing Sheets

ALTERNATING TREAD LADDER APPARATUS

TECHNICAL FIELD

This invention relates to ladders having alternating steps or treads.

BACKGROUND OF THE INVENTION

Ladders are known in which the treads or rungs are alternately arranged along a single stringer or pole. Such ladders are shown by way of example in U.S. Pat. Nos. 4,199,040 and 4,328,880. This invention concerns improvements to such general ladder designs.

BRIEF DESCRIPTION OF THE DRAWINGS

Preferred embodients of the invention are illustrated in the accompanying drawings, in which.

DETAILED DESCRIPTION OF THE PREFERRED EMBODIMENTS

The following disclosure of the invention is submitted in furtherance with the constitutional purpose of the Patent Laws "to promote the progress of science and useful arts" (Article 1, Section 8).

Figure 1:
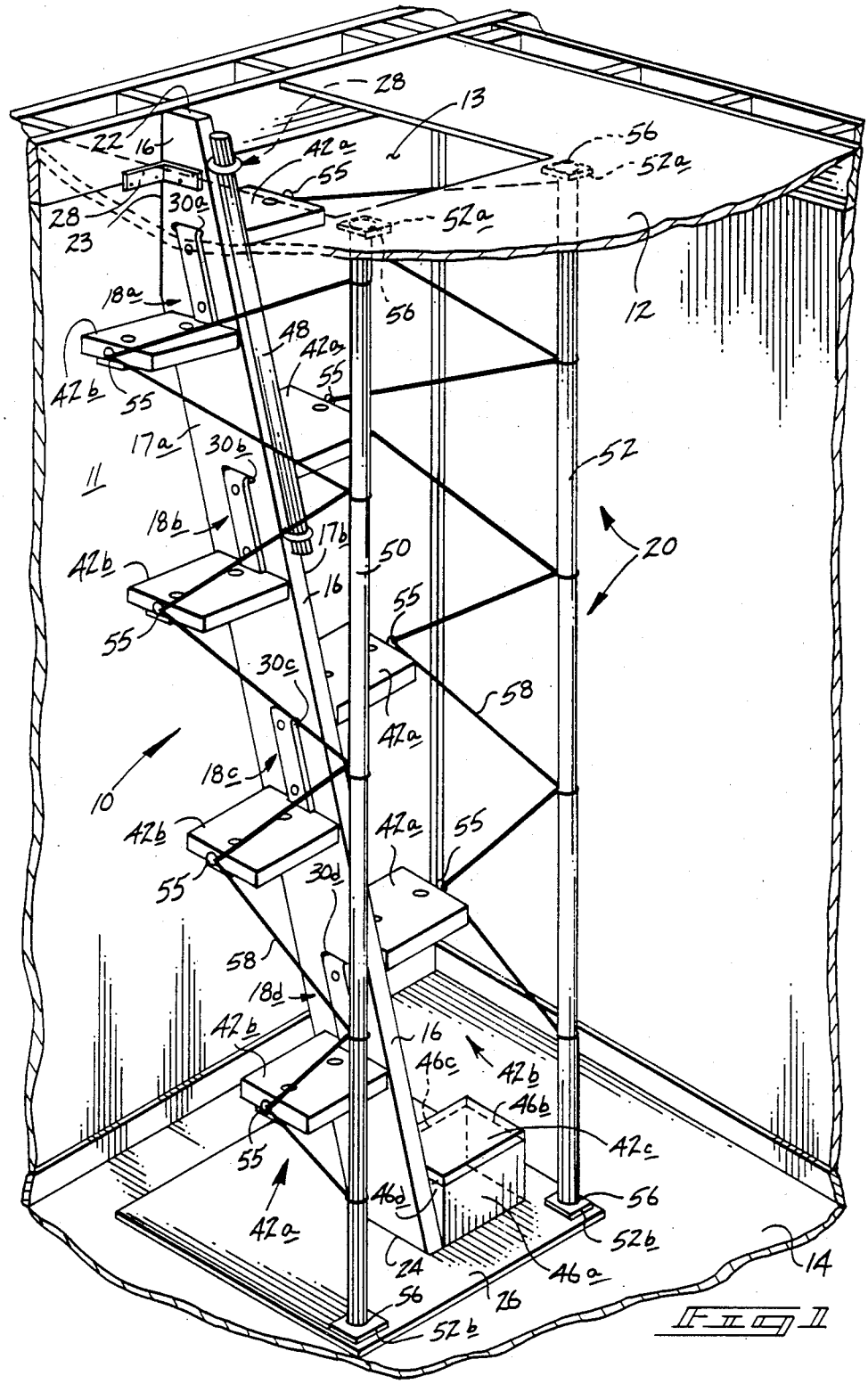
FIG. 1 is a perspective view of an alternating tread ladder apparatus in accordance with the invention.
Figure 2:
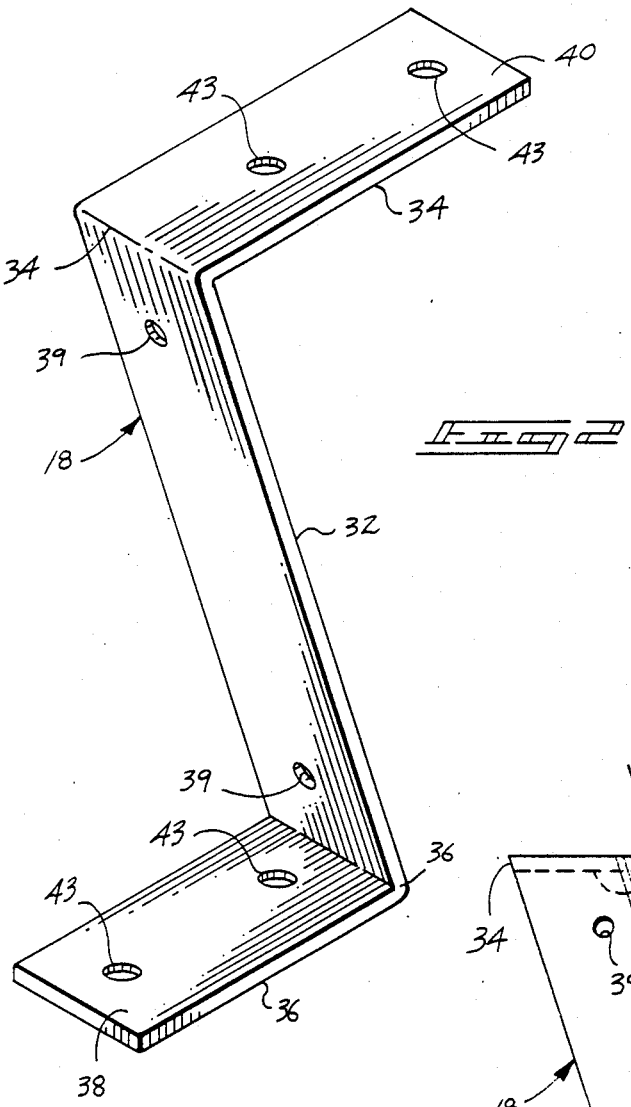
FIG. 2 is a perspective view of one tread step bracket shown in use with the ladder apparatus of FIG. 1.

Referring to FIG. 1, an alternating tread ladder apparatus in accordance with the invention is indicated generally by reference numeral 10. Apparatus 10 is shown mounted against a wall 11 and extends generally between an opening 13 of an upper floor level 12 and a lower floor level 14 at some predetermined forward angle of inclination. This enables alternating tread ladder apparatus 10 to take up less space than is normally required by a conventional staircase. In accordance with the invention, the preferred angle of inclination is approximately equal to 18° from vertical.

Ladder apparatus 10 as shown is comprised primarily of; (a) a single elongated central support or stringer 16 which mounts between upper level 12 and lower level 14 at the predetermined angle of inclination, (b) a plurality of tread step bracket means **18*a*, 18*b*, 18*c* and 18*d* mounted to central tread support 16 for supporting the weight of a person using ladder apparatus 10, and (c) a rope lattice handle/guard system 20**.

More particularly, elongated central tread support 16 is comprised of a normal 2 inch by 10 inch wooden board having opposed ends 22 and 24. Top board end 22 is cut along the length of the board at the predetermined 18° angle of inclination. This provides a surface 23 on support 16 which bears against room wall 11 to angle support 16 upwardly at the angle of inclination. Bottom end 24 of elongated support 16 mounts to a thin square plywood ladder base 26 which rests on lower level 14, and thereby supports central support 16 relative thereto. Top support end 22 is secured relative to wall 11 by a pair of right angle brackets 28 and wood screws positioned on opposite sides of support 16 (only one bracket 27 is visible in the drawings).

Tread support 16 has opposing elongated side surfaces **17*a* and 17*b*, and a width or thickness of 1½ inch (the standard width of a nominal two by ten). Central tread support 16 is provided with a plurality of generally laterally oriented tread support openings or apertures 30*a*, 30*b*, 30*c* and 30*d* which are positioned along the support and extend therethrough from side 17*a* to 17*b*. Apertures 30*a*, 30*b*, 30*c* and 30*d* are generally rectangular in cross-section to accommodate the shape of portions of the individual bracket means 18*a–d***, as is more fully described below.

Figure 3:
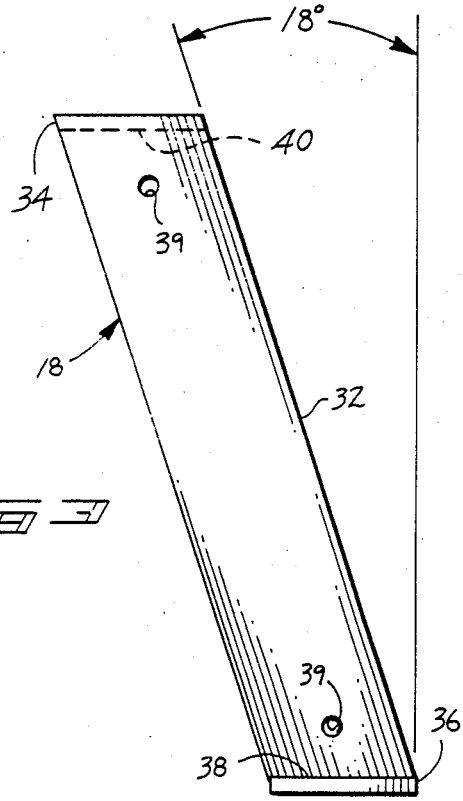
FIG. 3 is a side elevational view of the tread step bracket of FIG. 2.
Figure 4:
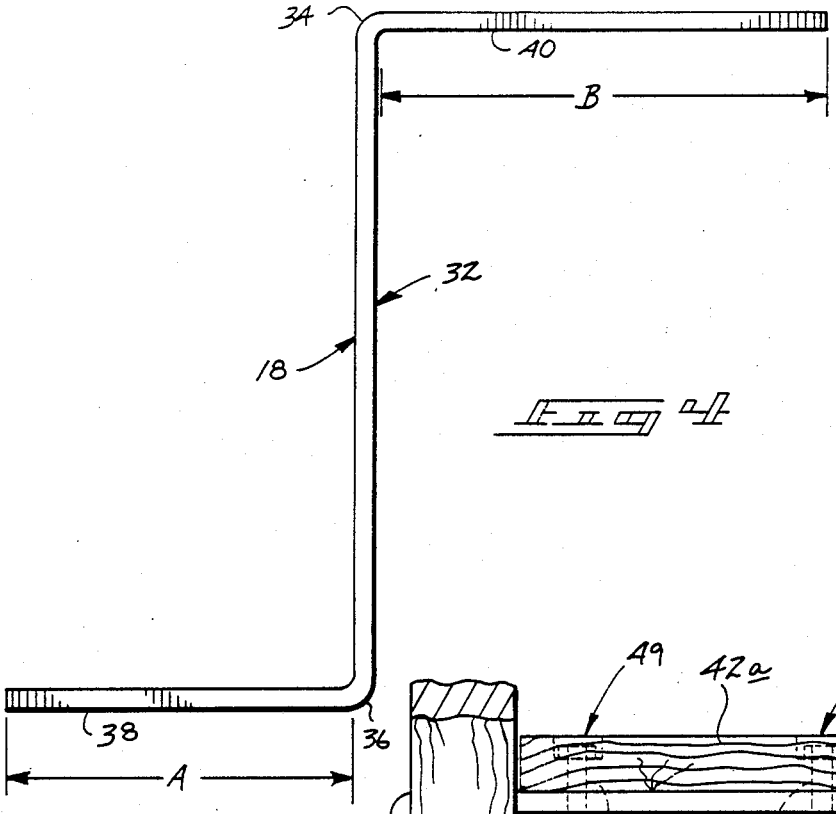
FIG. 4 is a rear elevational view of the tread step bracket of FIG. 2.

Referring to FIGS. 1–5, each tread step bracket means **18*a*, 18*b*, 18*c* and 18*d* is comprised of a forwardly angled, generally Z-shaped metal bracket 18. Bracket 18 includes a central body 32 having an upper end 34 and a lower end 36. An integral lower arm portion 38 extends laterally outward to the one side (the left side as shown) of body 32 from lower body end 36 outward to a predetermined first distance 'A' (FIG. 4). An integral upper arm portion 40 extends laterally outward to the opposite right side of body 32 adjacent upper body end 34 to a predetermined second distance 'B'. Predetermined second distance B is greater than distance A by an amount approximating the tread support width, which as described is approximately 1½ inch. This construction will thereby project arms 40 and 38 outward of support 16 the same relative distance. In the illustrated embodiment, both arm portions 38 and 40 are sized correspondingly with apertures 30*a*, 30*b*, 30*c*, and 30*d* to fit therethrough, only one arm portion (arm 40) is received through an opening because of the shape of bracket 18**.

A pair of holes 39 is provided laterally through bracket body 32, and receives a pair of screws 41 which thread to central support 16. Alternately, nut and bolt combinations could be provided and received by holes 39 as well a holes extending through support 16.

Bracket body 32 angles forwardly between upper and lower arm portions 38, 40 respectively, at the predetermined 18° angle of inclination (FIG. 3). As such, upper arm portion 40 is positioned on bracket body 32 forward of lower arm portion 38, and along the 18° angle of inclination. Once the upper or lower arm portions of the tread step bracket means extends laterally through one of the plurality of tread support apertures. In the illustrated and preferred embodiment, upper arm portion 40 extends laterally through one of the plurality of tread support apertures **30*a*, 30*b*, 30*c* or 30*d*, with bracket central body 32 being bolted to central tread support side 17*a*. The base surface within the apertures serve as a load bearing surface. The vast majority of the user's weight is supported by this surface within the apertures of the central support, rather than by the bolts or screws 41. The primary functiuon of screws 41 is to hold brcket 18** in place.

Figure 5:
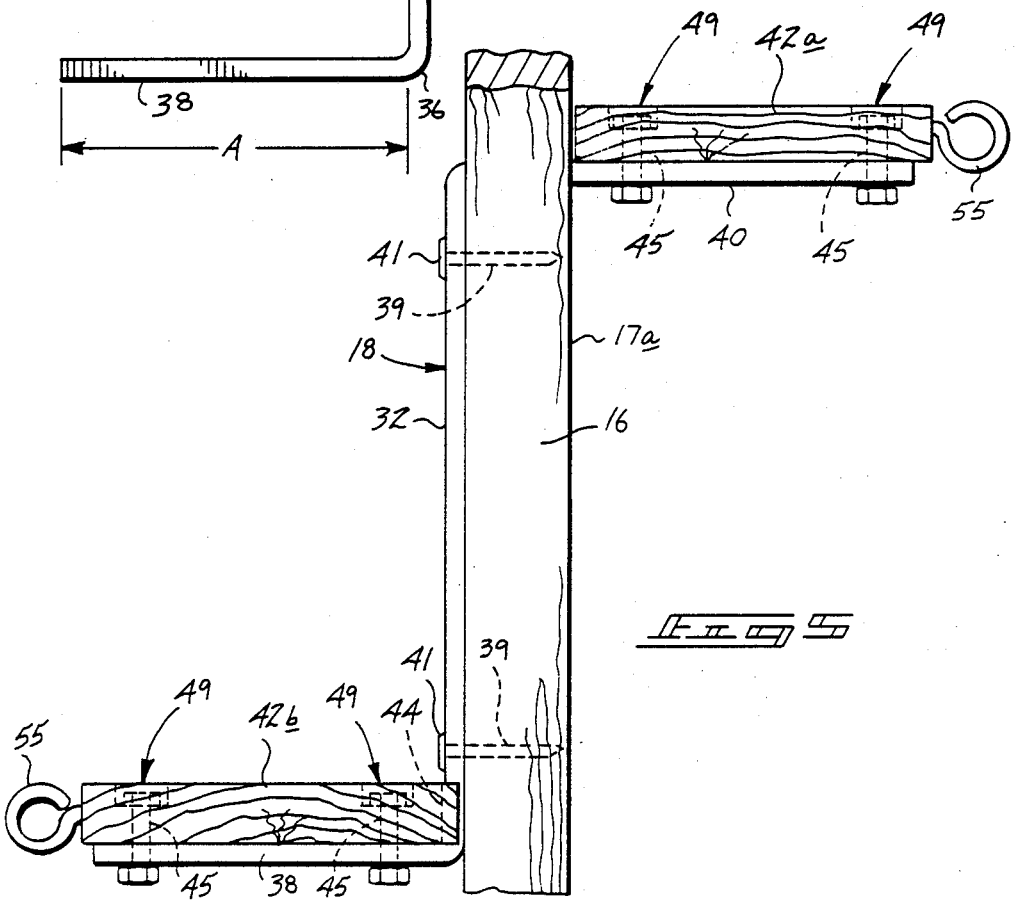
FIG. 5 is a rear elevational view of the tread step bracket of FIG. 2 shown as mounted to the alternating tread ladder apparatus of FIG. 1.

A pair of tread steps **42*a* and 42*b* are mounted to each of tread step bracket means 18*a*, 18*b*, 18*c* and 18*d*. Tread step 42*a* mounts to upper arm portion 40, while tread step 42*b* mounts to lower arm portiom 38 (FIG. 5). A pair of holes 43 is provided in each of bracket arms 38 and 40 for bolting tread steps 42*a* and 42*b* thereto with nut and bolt combinations 45. A pair of countersunk bores 49 is provided in each of tread steps 42***a* and 42*b* such that the mounting bolt heads are positioned just beneath the step surface.

The inner edge of tread steps 42*b* includes a rectangular cut-out notch 44 through which central bracket body 32 extends to accommodate its thickness. This enables tread 42*b* to be received essentially flush against side 17*a* of tread support 16, like tread step 42*a* is essentially received.

Apparatus 10 is preferably constructed to provide ten inches of vertical rise between each alternating step, with the surface of upper level 12 providing the last step. Depending upon the distance between the upper and lower levels, the lowermost step may be of a distance which is slightly less than ten inches to the ground. Of course, alternately, lower level 14 could be used as the starting reference point and the last step to upper level 12 would then typically be something other the ten inches. A bottom-most tread step 42*c* is illustrated in FIG. 1 as being slightly less than ten inches. It is supported to ladder base 26 by a series of four rectangular wooden side supports 46*a*, 46*b*, 46*c* and 46*d*.

Referring again specifically to FIG. 1, alternating tread ladder apparatus 10 is provided with a first cylindrical metal handle 48 which extends along at least the upper longitudinal facing edge of central tread support 16. A rope lattice handle/guard system 20 is also provided. It is comprised of a pair of second cylindrical metal handles 50, 52 which extends generally vertically between upper and lower levels 12, 14 respectively. As shown, second handles 50, 52 are mounted to the lower room ceiling and to ladder base 26 by pairs 52*a*, 52*b* of wooden plywood mounting brackets. Brackets 52*a* and 52*b* include a central hole 56 which receives the ends of rounded handles 52 or 54. Brackets 54 are glued, screwed, nailed or otherwise adhered to the ceiling and base 26.

A lattice of rope 58 serpentines between each of second handles 50 and 52 and the outer sides of the tread step bracket means. As illustrated, the outer edges of each tread steps 42*a* and 42*b* receives an eye screw 55 through which rope 58 extends. (FIGS. 1 and 5).

Figures 6, 7:
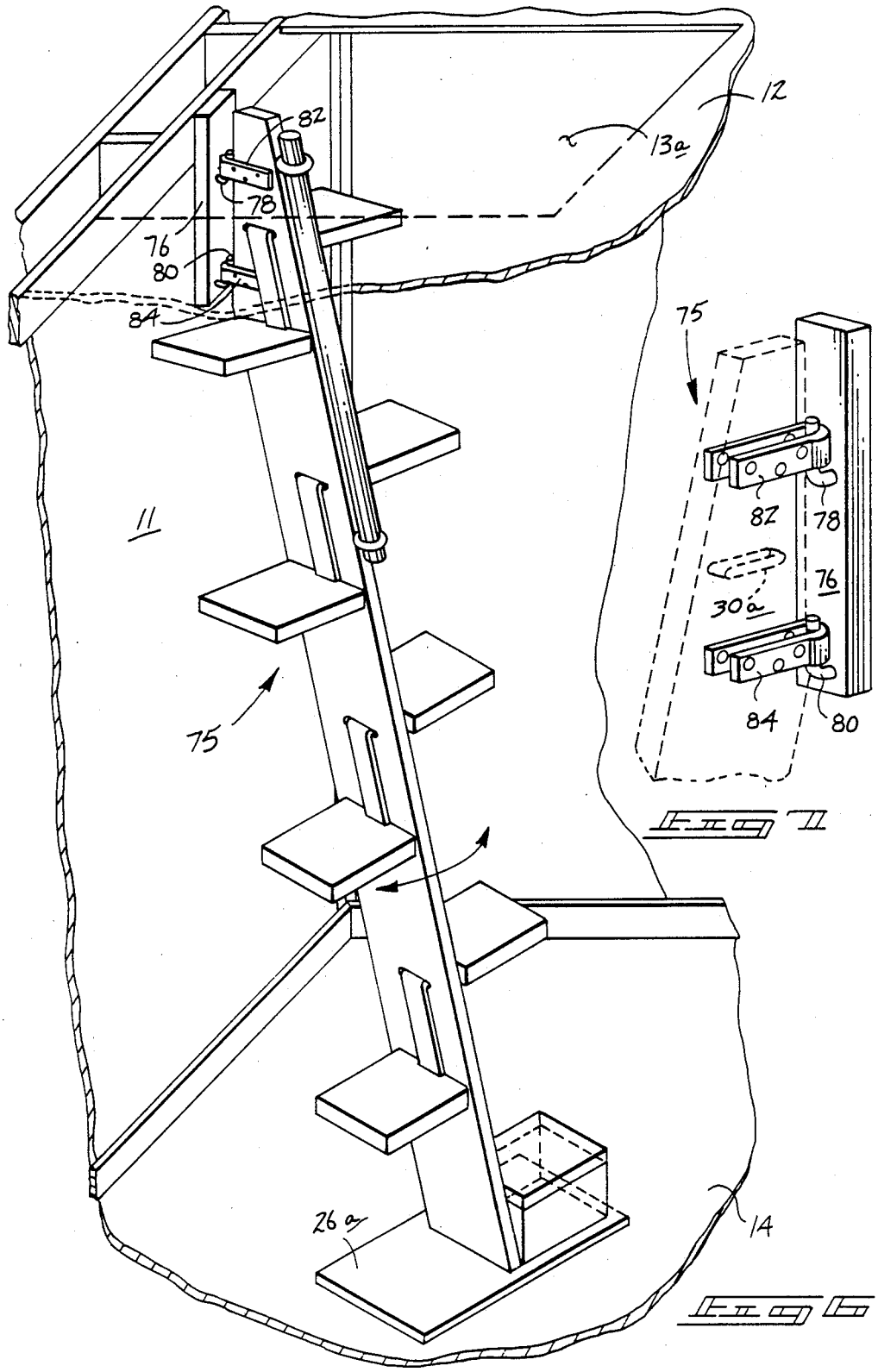
FIG. 6 is a perspective view of an alternate embodiment alternating tread ladder apparatus in accordance with the invention.
FIG. 7 is an enlarged partial perspective view of the hinge area of the apparatus illustrated by FIG. 6.

An alternate tread ladder apparatus 75 in accordance with the invention is illustrated in FIGS. 6 and 7. Apparatus 75 is similar to apparatus 10 such that only the major differences will be described. Apparatus 75 differs from apparatus 10 primarily in the way in which central support member 16 mounts relative to the upper level. As illustrated, an elongated vertical mounting base 76 is mounted relative to opening 13*a* adjacent upper floor 12, and extends downwardly. A pair of right angle posts 78, 80, which function as hinge pins, are mounted in vertical alignment with one another to base 76. A pair of brackets 82, 84 correspondingly mount to the sides of central support 16. These receive posts 78 and 80, and pivotally support central member 16 relative to base 76. Base 76, posts 78, 80 and brackets 82, 84 function as a pivotal support means for pivotally mounting the elongated central tread support 16 relative to upper level 12. This enables the entire ladder apparatus to be pivoted to one side or the other, as best illustrated in FIG. 6. A smaller base 26*a* is provided to facilitate movement. Further, a larger opening 13*a* to upper level 12 can be provided to better acommodate use of the ladder regardless of its angular orientation relative to wall 11.

In compliance with the statute, the invention has been described in language more or less specific as to structural feature. It is to be understood, however, that the invention is not limited to the specific features shown and described, since the means and contruction herein disclosed comprise a preferred form of putting the invention into effect. The invention is , therefore, claimed in any of its forms or modifications within the proper scope of the appended claims appropriately interpreted in accordance with the doctrine of equivalents.

I claim:

1. An alternating tread ladder apparatus comprising:

an elongated central tread support for mounting between an upper level and a lower level at a predetermined forward angle of inclination, the tread support having a plurality of generally laterally oriented tread support apertures positioned therealong and extending therethrough;

a plurality of tread step bracket means mounted to the central tread support for supporting the weight of a person using the ladder apparatus, the tread step bracket means comprising:

a central body having an upper end and a lower end;

a lower arm portion extending laterally outward of the body from adjacent the lower body end;

an upper arm portion extending laterally outward of the body from adjacent the upper body end, the upper arm portion being positioned on the body forward of the lower arm portion and along the predetermined angle of inclination; and at least one of the upper or lower arm portions of the tread step bracket means extending laterally through one of the plurality of tread support apertures.

2. The alternating tread ladder apparatus of claim 1 wherein the tread step bracket means further comprises tread steps mounted to the upper and lower arm portions.

3. The alternating tread ladder apparatus of claim 2 wherein one of the tread steps for each bracket means comprises an inner edge having a cut-out notch, the central body being received through the cut-out-notch.

4. The alternating tread ladder apparatus of claim 1 further comprising at least one handle extending along at least a portion of the elongated central tread support.

5. The alternating tread ladder apparatus of claim 1 further comprising:

a pair of handles for extending generally between the upper and lower levels; and a rope lattice extending between the handles and the tread step bracket means.

6. The alternating tread ladder apparatus of claim 5 wherein the pair of handles extends generally vertically between the upper and lower levels.

7. The alternating tread ladder apparatus of claim 5 further comprising a ladder base which mounts to the elongated central tread support and supports the apparatus relative to the lower level, the pair of handles mounting to the ladder base.

8. The alternating tread ladder apparatus of claim 2 further comprising:

a pair of handles for extending generally between the upper and lower levels; and a rope lattice extending between the handles and the tread steps.

9. The alternating tread ladder apparatus of claim 1 further comprising pivotal support means for pivotally mounting the elongated central tread support relative to the upper level.

10. An alternating tread ladder apparatus comprising:
an elongated central tread support for mounting between an upper level and a lower level at a predetermined forward angle of inclination, the tread support having opposing elongated sides and a plurality of generally laterally oriented tread support apertures positioned along the support and extending therethough;
a plurality of tread step bracket means mounted to the central tread support for supporting the weight of a person using the ladder apparatus, the tread step bracket means comprising:
a central body having an upper end and a lower end, the bracket central body being mounted against one of the opposing elongated tread support sides;
a lower arm portion extending laterally outward to one side of the body from adjacent the lower body end;
an upper arm portion extending laterally outward of the body to a side opposite the one body side and from adjacent the upper body end, the upper arm portion being positioned on the body forward of the lower arm portion and along the predetermined angles of inclination; and
the upper arm portion of the tread step bracket means extending laterally through one of the plurality of tread support apertures.

11. The alternating tread ladder apparatus of claim 10 wherein the tread step bracket means further comprises tread steps mounted to the upper and lower arm portions.

12. The alternating tread ladder apparatus of claim 11 wherein the tread step mounted to the lower arm portion comprises an inner edge having a cut-out notch, the central body being received through the cut-out notch.

13. The alternating tread ladder apparatus of claim 10 wherein, the elongated central tread support has a predetermined width; and
the lower and upper arm portions extend outwardly from the central body to predetermined first and second respective distances, the first distance being less than the second distance by an amount approximately equal to the predetermined tread support width.

14. The alernating tread ladder apparatus of claim 13 wherein the tread step bracket means further comprises:
tread steps mounted to the upper and lower arm portions; and
the tread step mounted to the lower arm portion including an inner edge having a cut-out notch, the central body being received through the cut-out notch.

15. The alternating tread ladder apparatus of claim 10 further comprising:
a pair of handles for extending generally between the upper and lower levels; and
a rope lattice extending between the handles and the tread step bracket means.

16. The alternating tread ladder apparatus of claim 15 wherein the pair of handles extends generally vertically between the upper and lower levels.

17. The alternating tread ladder apparatus of claim 15 further comprising a ladder base which mounts to the elongated central tread support and supports the apparatus relative to the lower level, the pair of handles mounting to the ladder base.

18. The alternating tread ladder apparatus of claim 10 further comprising pivotal support means for pivotally mounting the elongated central tread support relative to the upper level.

19. The alternating tread ladder apparatus of claim 18 wherein,
the elongated central tread support has a predetermined width;
the lower and upper arm portions extend outwardly from the central body to predetermined first and second respective distances, the first distance being less than the second distance by an amount approximately equal to the predetermined tread support width;
the tread step bracket means further comprises:
tread steps mounted to the upper and lower arm portions; and
the tread step mounted to the lower arm portion including an inner edge having a cut-out notch, the central body being received through the cut-out notch.

20. For an alternating tread ladder apparatus having an elongated central tread support for mounting between an upper level and a lower level at a predetermined forward angle of inclination, the tread support having opposing elongated sides, a predetermined width, and a plurality of generally laterally oriented tread support apertures positioned along the support and extending therethough; a tread step bracket for mounting to the central tread support to support the weight of a person using the ladder appartus, the tread step bracket comprising:
a central body having an upper end and a lower end;
a lower arm portion extending laterally outward to one side of the central body from adjacent the lower body end, the lower arm portion extending outward to a predetermined first distance; and
an upper arm portion extending laterally outward of the central body to a side opposite the one side of the central body and from adjacent the upper body end, the upper arm portion being positioned on the body forward of the lower arm portion and along the predetermined angle of inclination, the upper arm portion extending outward to a predetermined second distance, one of the predetermined first or second distances being greater than the other by an amount approximately equal to the predetermined tread support width.

21. The tread step bracket of claim 20 wherein it is the predetermined second distance which is greater than the predetermined first distance.

22. For an alternating tread ladder apparatus having an elongated central tread support for mounting between an upper level and a lower level at a predetermined forward angle of inclination, the tread support having opposing elongated sides, a predetermined width, and a plurality of generally laterally oriented tread support apertures positioned along the support and extending therethrough; a tread step bracket for mounting to the central tread support to suoppport the weight of a person using the ladder apparatus, the tread step bracket comprising:
a central body having an upper end and a lower end;
a lower arm portion extending laterally outward of the body from adjacent the lower body end;
an upper arm portion extending laterally outward of the body from adjacent the upper body end, the upper arm portion being positioned on the body forward of the lower arm portion and along the predetermined angle of inclination; and at least one of the upper or lower arm portions of the tread step bracket means being sized to extend laterally through one of the plurality of tread support apertures.

23. An alternating tread ladder apparatus comprising:

an elongated central tread support for mounting between an upper level and a lower level at a forward angle of inclination approximately equal to 18° from verticaal, the tread support having opposing elongated sides, a predetermined width, and a plurality of generally laterally oriented tread support apertures positioned along the support and extending therethrough, a first handle extending along at least a portion of the elongated central tread support;

a purality of tread step bracket means mounted to the central tread support for supporting the weight of a person using the ladder apparatus, the tread step bracket means comprising:

a central body having an upper end and a lower end, the bracket central bofy being bolted or screwed against one of the opposing elongated tread support sides;

a lower arm portion extending laterally outward to one side of the body from adjacent the lower body end, the lower arm portion extending outward to a predetermined first distance, and an upper arm portion extending laterally outward of the body to a side opposite the one body side and from adjacent the upper body end, the upper arm portion extending outward to a predetermined second distance, the predetermined second distance being greater than the predetermined first distance by an amount approximately equal to the predetermined tread support width, the upper arm portion being positioned on the body forward of the lower arm portion and along the 18° angle of inclination;

the upper arm portion of the tread step bracket means extending laterally through one of the plurality of tread support apertures;

tread steps mounted to the upper and lower arm portions, the tread step mounted to the lower arm portion including an inner edge having a cut-out notch, the central body being received through the cut-out notch;

a pair of second handles extending generally vertically between the upper and lower levels; and a rope lattice extending between the second handles and the tread steps.

* * * * *